US009103122B2

(12) United States Patent
Boss

(10) Patent No.: US 9,103,122 B2
(45) Date of Patent: Aug. 11, 2015

(54) TPO ROOFING APPARATUS, SYSTEMS, AND METHODS

(71) Applicant: BUILDING MATERIALS INVESTMENT CORPORATION, Wilmington, DE (US)

(72) Inventor: Daniel Boss, Parker, TX (US)

(73) Assignee: BUILDING MATERIALS INVESTMENT CORPORATION, Dallas, TX (US)

( * ) Notice: Subject to any disclaimer, the term of this patent is extended or adjusted under 35 U.S.C. 154(b) by 0 days.

(21) Appl. No.: 14/211,075

(22) Filed: Mar. 14, 2014

(65) Prior Publication Data

US 2014/0260035 A1 Sep. 18, 2014

Related U.S. Application Data

(60) Provisional application No. 61/788,082, filed on Mar. 15, 2013.

(51) Int. Cl.

| | |
|---|---|
| ***E04D 5/02*** | (2006.01) |
| ***E04D 5/14*** | (2006.01) |
| ***E04D 5/06*** | (2006.01) |
| *E04D 5/08* | (2006.01) |
| *E04D 5/10* | (2006.01) |

(52) U.S. Cl.
CPC ... *E04D 5/06* (2013.01); *E04D 5/08* (2013.01); *E04D 5/10* (2013.01)

(58) Field of Classification Search
CPC ..... E04D 5/02; E04D 5/14; E04D 5/06; E04D 5/08; E04D 5/10
USPC ..... 52/408, 409, 410, 411, 412, 413
See application file for complete search history.

(56) References Cited

U.S. PATENT DOCUMENTS

| | | | | |
|---|---|---|---|---|
| 4,394,807 | A * | 7/1983 | Carroll | 52/332 |
| 5,309,685 | A * | 5/1994 | Rathgeber et al. | 52/58 |
| 5,479,753 | A * | 1/1996 | Williams | 52/741.4 |
| 6,554,947 | B2 * | 4/2003 | Pfotenhauer et al. | 156/304.1 |
| 6,640,511 | B1 * | 11/2003 | Link | 52/410 |
| 7,069,698 | B2 * | 7/2006 | Nee | 52/24 |
| 7,430,837 | B2 * | 10/2008 | Hubbard | 52/408 |
| 7,666,491 | B2 | 2/2010 | Yang | |
| 7,686,056 | B2 * | 3/2010 | Peterson | 156/574 |
| 7,861,478 | B2 * | 1/2011 | Kalkanoglu et al. | 52/410 |
| 7,935,202 | B2 * | 5/2011 | Stanley | 156/71 |
| 8,015,770 | B2 * | 9/2011 | Kalkanoglu et al. | 52/410 |
| 8,057,631 | B2 * | 11/2011 | Peterson | 156/308.2 |
| 8,202,596 | B2 * | 6/2012 | Yang et al. | 428/40.1 |
| 8,230,656 | B2 * | 7/2012 | Kalkanoglu et al. | 52/410 |
| 8,322,113 | B2 * | 12/2012 | Shapiro et al. | 52/746.11 |
| 8,381,450 | B2 * | 2/2013 | Cummings et al. | 52/57 |
| 8,499,524 | B2 * | 8/2013 | Stanley | 52/698 |
| 8,524,029 | B2 * | 9/2013 | Stanley | 156/292 |
| 8,557,070 | B2 * | 10/2013 | Stanley | 156/71 |

(Continued)

*Primary Examiner* — Rodney Mintz
(74) *Attorney, Agent, or Firm* — Baker & McKenzie LLP

(57) ABSTRACT

The present disclosure relates, in some embodiments, to TPO roofing apparatus, systems, and methods. For example, a method may include applying profiles to a substrate before applying a TPO membrane to the substrate. For example, an installation method may comprise, in some embodiments, laying out the spacing for one or more roof profiles on a substrate (e.g., a roof deck), attaching the one or more profiles to the substrate, applying a membrane (e.g., a self-adhesive TPO membrane) to the substrate between the profiles, and/or sealing the edges of the membrane to the profiles.

20 Claims, 3 Drawing Sheets

(56) References Cited

U.S. PATENT DOCUMENTS

| | | | | |
|---|---|---|---|---|
| 8,608,884 | B2 * | 12/2013 | Stanley | 156/71 |
| 8,623,158 | B2 * | 1/2014 | Stanley | 156/71 |
| 8,677,702 | B2 * | 3/2014 | Jenkins | 52/173.3 |
| 8,678,058 | B2 * | 3/2014 | Cummings et al. | 156/391 |
| 8,966,838 | B2 * | 3/2015 | Jenkins | 52/173.3 |
| 2002/0170254 | A1 * | 11/2002 | Ritland et al. | 52/408 |
| 2003/0070391 | A1 * | 4/2003 | Tachauer et al. | 52/745.21 |
| 2003/0219568 | A1 * | 11/2003 | Nee | 428/138 |
| 2005/0115162 | A1 * | 6/2005 | Nee | 52/24 |
| 2006/0046084 | A1 * | 3/2006 | Yang et al. | 428/500 |
| 2007/0193167 | A1 * | 8/2007 | Bruce et al. | 52/408 |
| 2007/0193168 | A1 * | 8/2007 | Fritz | 52/410 |
| 2007/0266672 | A1 * | 11/2007 | Bateman et al. | 52/747.1 |
| 2008/0179574 | A1 * | 7/2008 | Yang et al. | 252/601 |
| 2009/0107073 | A1 * | 4/2009 | Kalkanoglu et al. | 52/411 |
| 2009/0211621 | A1 * | 8/2009 | LeBlanc | 136/244 |
| 2010/0197844 | A1 * | 8/2010 | Yang et al. | 524/427 |
| 2010/0242381 | A1 * | 9/2010 | Jenkins | 52/173.3 |
| 2011/0000158 | A1 * | 1/2011 | Kalkanoglu et al. | 52/309.3 |
| 2011/0016811 | A1 * | 1/2011 | Kalkanoglu et al. | 52/309.1 |
| 2011/0023390 | A1 * | 2/2011 | Kneip et al. | 52/173.3 |
| 2011/0061788 | A1 * | 3/2011 | Stanley | 156/66 |
| 2011/0138602 | A1 * | 6/2011 | Stanley | 29/428 |
| 2011/0155319 | A1 * | 6/2011 | Cummings et al. | 156/308.4 |
| 2011/0159224 | A1 * | 6/2011 | Yang et al. | 428/41.8 |
| 2011/0162779 | A1 * | 7/2011 | Stanley | 156/66 |
| 2011/0219715 | A1 * | 9/2011 | Shapiro et al. | 52/309.1 |
| 2011/0240207 | A1 * | 10/2011 | Stanley | 156/91 |
| 2012/0222811 | A1 * | 9/2012 | Cummings et al. | 156/308.4 |
| 2013/0118545 | A1 * | 5/2013 | Bosler et al. | 136/244 |
| 2013/0130581 | A1 * | 5/2013 | Xing et al. | 442/1 |
| 2013/0316157 | A1 * | 11/2013 | Yang | 428/214 |
| 2014/0173997 | A1 * | 6/2014 | Jenkins | 52/58 |

* cited by examiner

TPO ROOFING APPARATUS, SYSTEMS, AND METHODS

CROSS-REFERENCE TO RELATED APPLICATIONS

This application claims priority to U.S. Provisional Application No. 61/788,082 filed Mar. 15, 2013, the contents of which are hereby incorporated in their entirety by reference.

FIELD OF THE DISCLOSURE

The present disclosure relates, in some embodiments, to TPO roofing apparatus, systems, and methods.

BACKGROUND OF THE DISCLOSURE

TPO versions of metal seam roofing may be installed by unrolling and adhering a wide (e.g., 10 foot wide) sheet of material to a substrate (e.g., roof deck) and subsequently installing standing seam profiles. This method requires laying out the lines, cleaning the TPO, priming the TPO, removing the strippable film from the standing seam profile, adhering the profile, and then sealing both edges of the profile with a hot glue gun. Accordingly, this is a tedious and expensive installation method.

SUMMARY

Accordingly, a need has arisen for improved roofing TPO apparatus, systems, and methods. The present disclosure relates, according to some embodiments, to roofing TPO apparatus, systems, and methods. For example, an installation method may comprise, in some embodiments, laying out the spacing for one or more roof profiles on a substrate (e.g., a roof deck), attaching the one or more profiles to the substrate, applying a membrane (e.g., a self-adhesive TPO membrane) to the substrate between the profiles, and/or sealing the edges of the membrane to the profiles.

A method for cladding a structure comprising a roofing substrate may include, for example, (a) positioning two or more profiles, each profile having a base and a body fixed above the base, on a substrate, wherein the two or more profiles are parallel or substantially parallel to each other and separated from each other by spacing(s); (b) fastening the base of each of the two or more profiles to the substrate; (c) applying a TPO membrane between each pair of profiles, the TPO membrane having sufficient width to at least partly overlap the base of each adjacent profile and form two or more TPO membrane—profile seams; and/or (d) sealing each TPO membrane—profile seam. Each profile may be separated from the next adjacent profile by a spacing. In some embodiments, adjacent profiles may be said to define a spacing therebetween. In some embodiments, the width of the TPO membrane is the same or substantially the same as the profile spacing(s). The width of a TPO membrane may be about 1 foot to about 3 feet (e.g., about 2 feet). Fastening the base of each of the two or more profiles to the substrate may further comprise adhering and/or mechanically fastening (e.g., nailing, screwing) each of the two or more profiles to the substrate. Sealing each TPO membrane—profile seam may further comprise welding the seam, caulking the seam, gluing the, or combinations thereof. In some embodiments, a TPO membrane may be a colored membrane (e.g., white, sand, others). A TPO membrane may be configured to mimic a metallic roof material. In some embodiments, a method may further comprise rolling the overlap to secure it to the underlying profile base (e.g., before sealing a profile—membrane seam).

The present disclosure relates in some embodiments to TPO membrane systems. Methods may comprise, for example, (a) a substrate; (b) a first profile having a first profile base and a first profile body fixed above the first profile base, wherein the first profile is fastened to the substrate; (c) a second profile having a second profile base and a second profile body fixed above the second profile base, wherein the second profile is fastened to the substrate parallel or substantially parallel to the first profile and spaced apart from the first profile by spacing(s); and/or (d) a TPO membrane adhered to the substrate between the first and second profiles, wherein the TPO membrane has sufficient width to at least partly overlap the first profile base and the second profile base and form a TPO membrane—first profile seam and a TPO membrane—second profile seam. In some embodiments, a first profile and/or a second profile may be independently selected from a batten seam profile or a standing seam profile. A profile may be fastened to a substrate with nails and/or screws. According to some embodiments, the width of the TPO membrane is the same or substantially the same as the profile spacing(s). A TPO membrane may comprise a single layer, at least two layers, or a plurality of layers. A system may further comprise, in some embodiments, a resistant seal along the TPO membrane—first profile seam and the TPO membrane—second profile seam. The width of a TPO membrane may be about 1 foot to about 3 feet (e.g., about 2 feet).

BRIEF DESCRIPTION OF THE DRAWINGS

Some embodiments of the disclosure may be understood by referring, in part, to the present disclosure and the accompanying drawings, wherein.

Figure 1A:
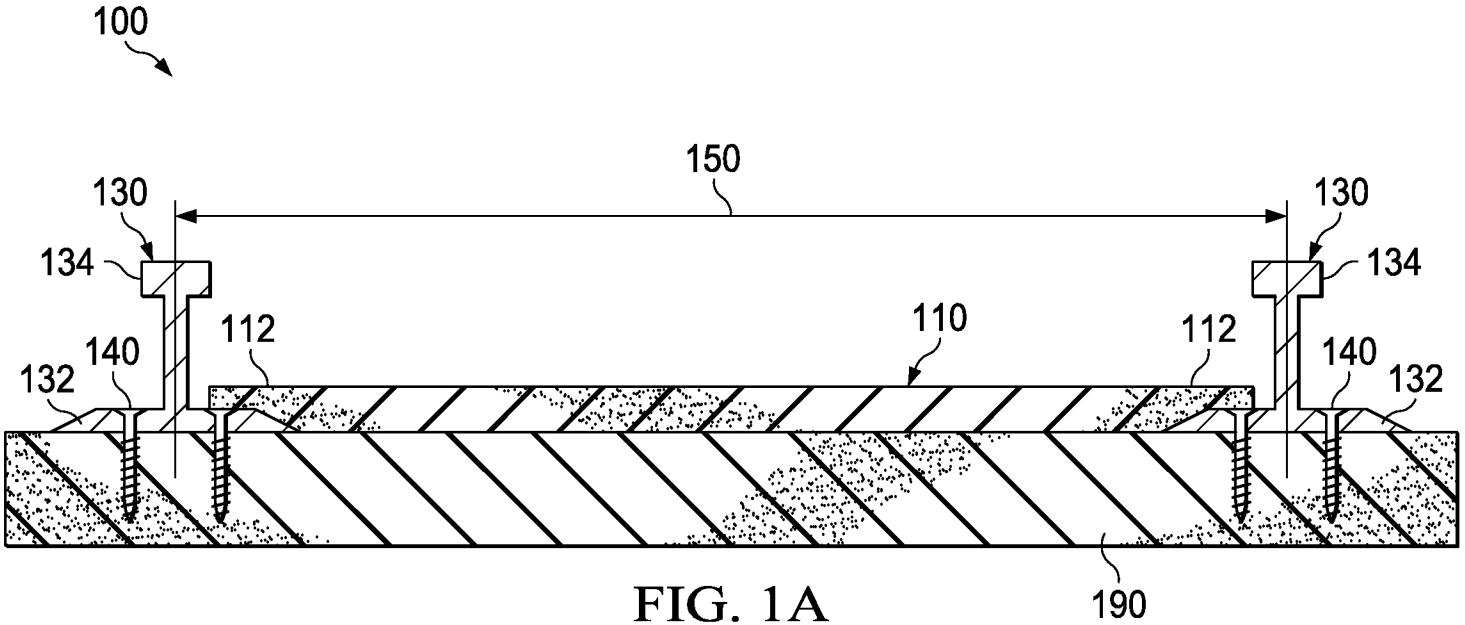
FIG. 1A is a profile view of a TPO apparatus according to a specific example embodiment of the disclosure.

Table 1 below includes the reference numerals used in this application. The thousands and hundreds digits correspond to the figure in which the item appears while the tens and ones digits correspond to the particular item indicated. Similar structures share matching tens and ones digits.

| Number | Article |
|---|---|
| 100 | System |
| 110 | TPO sheet |
| 112 | TPO overlap |
| 120 | TPO roll |
| 130 | Profile |
| 132 | Profile foot |
| 140 | Profile fastener |
| 150 | Profile spacing |
| 160 | Seal |
| 190 | Substrate |

DETAILED DESCRIPTION

The present disclosure relates, according to some embodiments, to TPO roofing apparatus, systems, and methods. TPO roofing methods may simplify (e.g., greatly simplify) installation, eliminate a need for spools of polymer for welding profiles to the TPO, and/or save significant labor costs, in some embodiments.

An apparatus and/or system may be applied to a roofing having any desired slope. For example, in some embodiments, an apparatus and/or system may be applied to a roofing having a low and/or zero slope. A low slope roof may have a pitch that rises about 3 feet per about 10 feet (or more) of horizontal distance. Single ply membranes in low slope applications may be installed above a layer of insulation such as polyisocyanurate (polyiso) slab stock foam. Polyiso foam is produced with a facer on either side, typically a cellulosic felt or paper. Closely spaced mechanical fasteners used for mechanical attachment of the overlap section of the two membranes to the underlying roofing structure in the conventional method of installation. Such mechanical fasteners typically consist of metal plates and screws that penetrate down through the insulation (polyiso boards) and into the supporting steel or other type of deck material. Membrane punctures created by installation of mechanical fasteners in this manner may compromise the integrity of the water barrier.

In some embodiments, profiles may be installed before and/or below TPO membranes. A method may include, for example, laying out the spacing for the profiles on a roof deck, attaching profiles to the deck (e.g., directly to the deck), installing a TPO membrane (e.g., a self-adhered TPO membrane) to overlap at least a portion of adjoining profiles (e.g., profile feet), sealing the TPO membrane—profile junction. TPO membranes may be applied in narrow (e.g., about 1' to about 3' wide) sheets.

The present disclosure relates to installation methods for TPO roofing systems with profiles having any desired configuration. For example, a profile may comprise a batten seam profile, a standing seam profile, or any other profile. A TPO roofing system may be configured to look like and/or otherwise mimic a batten or standing seam metal roofing. A profile may comprise a semi-rigid thermoplastic. In some embodiments, a profile may be fastened to a substrate (e.g., a roof deck) by any desired means including adhesives, mechanical fasteners, and/or combinations thereof. For example, a profile may have a self-adhering and/or pressure-sensitive adhesive with which it may be fastened to a substrate (e.g., a roof deck). A profile may be mechanically fastened to a substrate (e.g., a roof deck), for example, using screws and/or nails. A profile and/or a TPO membrane may be fixed to a substrate and/or each other by heat welding, gluing, caulking, sealing, and/or combinations thereof.

Installation Methods

For example, the present disclosure relates to installation methods for TPO roofing systems with standing seams and other profiles. An installation method may comprise, in some embodiments, laying out the spacing for one or more roof profiles on a substrate (e.g., a roof deck), attaching the one or more profiles to the substrate, applying a membrane (e.g., a self-adhesive TPO membrane) to the substrate between the profiles, sealing the edges of the membrane to the profiles, and/or combinations thereof. Applying a self-adhered TPO membrane between the profiles may comprise attaching the membrane to the substrate so that it overlaps the base or "feet" of the profile. Profiles may be spaced apart and/or TPO membrane width may be sized to select the degree of overlap desired or required. For example, the overlap may be configured to physically cover mechanical fasteners used to secure profiles to the substrate, if any. Accordingly, mechanical fasteners may be used to secure profiles without compromising the integrity of the water barrier. An overlapped portion of an applied membrane may be rolled to secure it in place. The seal between the TPO and profile "feet" may also be heat welded, or otherwise glued, caulked, and/or sealed in place.

Compositions

The present disclosure related, in some embodiments, to a roofing system comprising TPO membranes. TPO based roofing membranes are one of many types of roofing membranes available on the market today. TPO may be a melt blend or reactor blend of a polyolefin plastic, such as a polypropylene polymer, with an olefin copolymer elastomer (OCE), such as an ethylene-3Q propylene rubber (EPR) or an ethylene-propylene-diene rubber (EPDR). Examples of commercially available TPO membranes include SURE WELD™ (Carlisle Inc.), GENFLEX™ (Omnova Solutions, Inc.), ULTRAPLY™ (Firestone Building Products) and EVERGUARD TPO™ (OAF). Stretchable TPO membranes are disclosed in U.S. Pat. No. 7,666,491, which is also commonly-owned and incorporated by reference herein. A TPO membrane, according to some embodiments, may comprise one or more layers.

Specific Example Embodiments

Figure 1B:
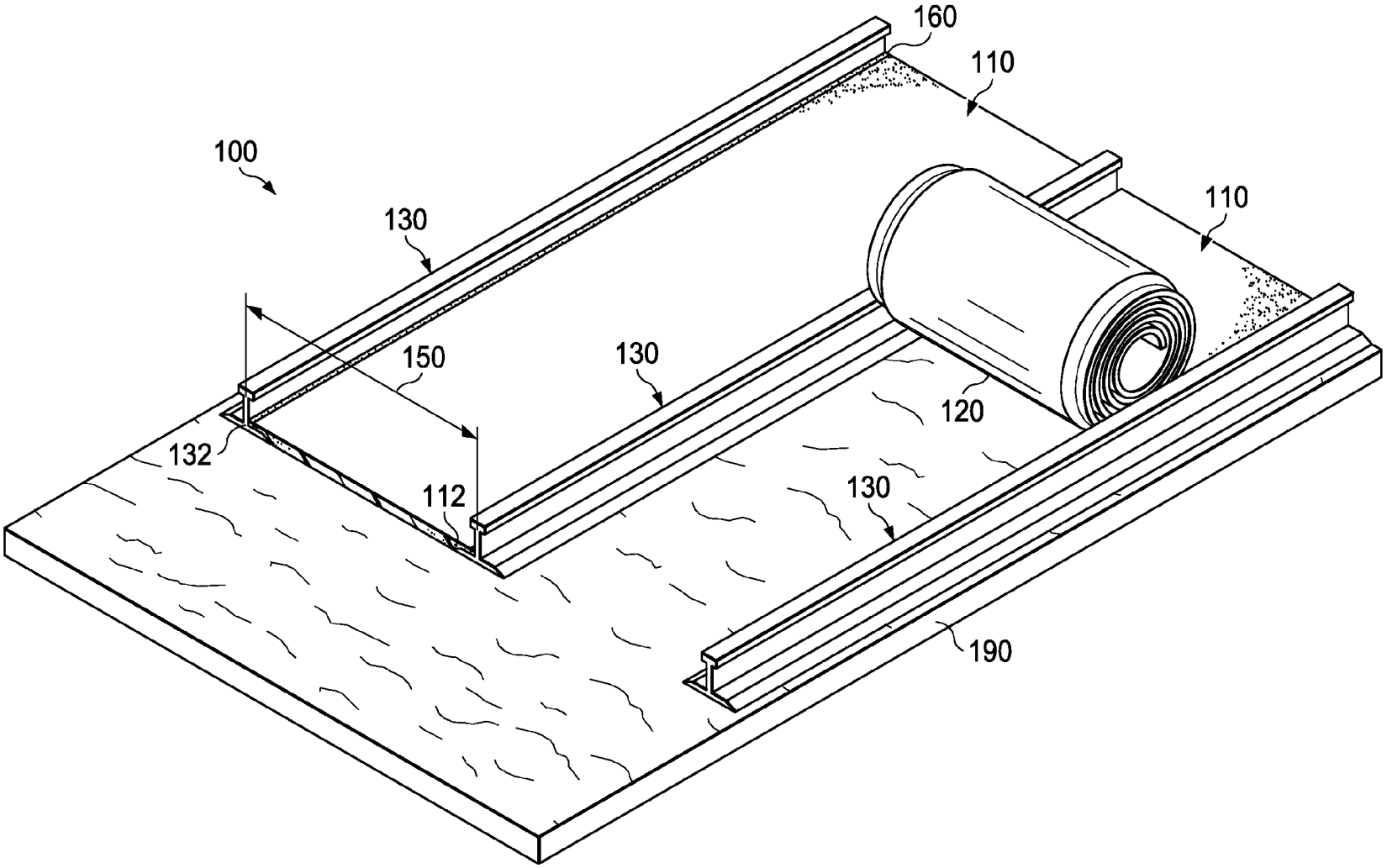
FIG. 1B is a perspective view of a TPO system according to a specific example embodiment of the disclosure.

Specific example embodiments of a TPO roofing system are illustrated in FIGS. 1A-1B. As illustrated in FIG. 1A, TPO roofing system 100 comprises substrate 190 and at least 2 profiles 130, each fixed to substrate 190 by fasteners 140. System 100 further comprises TPO membrane 110 positioned between profiles 130. Each profile may have base 132 and beam 134 fixed to and rising above base 132. Profiles may be separated by spacing 150. Spacing 150 may be constant or substantially constant along the length of profiles 130. In some embodiments, spacing 150 may be about 1' to about 3', for example, 2'. TPO membrane 110 may extend across spacing 150 from one profile 130 to the next. TPO membrane 110 may include overlap 112, which, as shown, partially covers base 132 of profile 130. In some embodiments, TPO membrane 110 may extend all the way to beam 134.

FIG. 1B illustrates installation of system 100. Profiles 130 are spaced apart by spacing 150 and fixed in place by fasteners 132. Roll 120 of self-adhesive TPO membrane 110 is applied to substrate 190 between adjacent fixed fasteners 130 such that its width spans all or substantially all of spacing 150. For example, roll 120 may be unrolled between two parallel profiles 130 as shown. Seal 160 may be applied to the junction between the edges of TPO membrane 110 and profile 130. While a cutaway view of the TPO membrane 110 is provided toward the top left of FIG. 1A, the ends of TPO membranes 110 may be sealed, for example, using seal 160.

Figure 2:
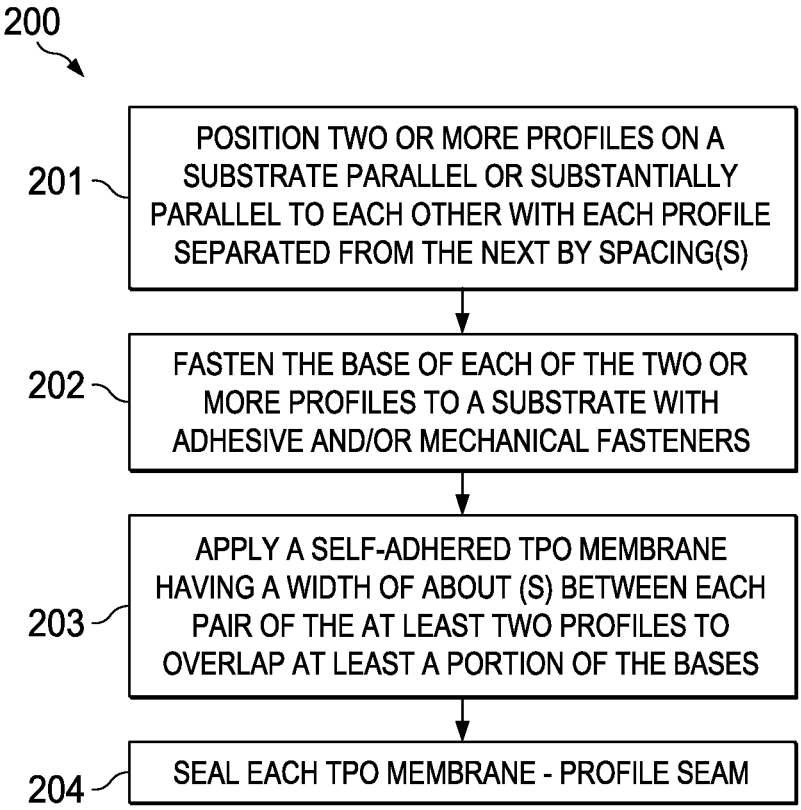
FIG. 2 illustrates method for installing a TPO roof system according to a specific example embodiment of the disclosure.

FIG. 2 illustrates method 200 for installing a TPO roof system. According to step 201, two or more profiles (e.g., each having a base and a beam fixed to and rising above the base) are positioned on a substrate such that they are parallel or substantially parallel to each other. The profiles are positioned such that they are separated by spacing(s). In step 202, profiles are fastened to the substrate at their bases with adhesive and/or mechanical fasteners. In step 203, a self-adhered TPO membrane is applied to the substrate between adjacent profiles. The TPO membrane has a width of up to spacing(s) so that it overlaps at least a portion of the profile bases. The overlap leaves a gap or seam between the edges of the TPO membrane and the profiles. In step 204, these seams are sealed.

As will be understood by those skilled in the art who have the benefit of the instant disclosure, other equivalent or alternative compositions, devices, methods, and systems for cladding a roof with a TPO membrane can be envisioned without departing from the description contained herein. Accordingly, the manner of carrying out the disclosure as shown and described is to be construed as illustrative only.

Persons skilled in the art may make various changes in the shape, size, number, and/or arrangement of parts without departing from the scope of the instant disclosure. For example, the position and number of profiles, membranes, and/or fasteners may be varied. In some embodiments, fasteners, profiles, and/or membranes of various kinds may be interchangeable. Interchangeability may allow the appearance, structure, and/or durability to be custom adjusted. In addition, the size of a device and/or system may be scaled up or down to suit the needs and/or desires of a practitioner. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition, device, and/or system of the disclosure.

All or a portion of a device and/or system for cladding a roof with a TPO membrane may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. A TPO membrane roof system, consisting of:

a substrate;

a first profile having a first profile base and a first profile body fixed above the first profile base, wherein the first profile is fastened to the substrate;

a second profile having a second profile base and a second profile body fixed above the second profile base, wherein the second profile is fastened to the substrate parallel or substantially parallel to the first profile and spaced apart from the first profile by spacing(s); and a TPO membrane adhered to the substrate between the first and second profiles, wherein the TPO membrane has sufficient width to at least partly overlap the first profile base and the second profile base and form a TPO membrane—first profile seam and a TPO membrane—second profile seam, wherein the TPO membrane—first profile seam adheres the TPO membrane to the first profile base and the TPO membrane—second profile seam adheres the TPO membrane to the second profile base, wherein the TPO membrane—first profile seam is adhered to the first profile base, and wherein the TPO membrane—second profile seam is adhered to the second profile base.

2. The TPO membrane roof system according to claim 1, wherein the first profile is a batten seam profile or a standing seam profile.

3. The TPO membrane roof system according to claim 1, wherein the second profile is a batten seam profile or a standing seam profile.

4. The TPO membrane roof system according to claim 1, wherein the fastened to the substrate further consists of nailed to or screwed to the substrate.

5. The TPO membrane roof system according to claim 1, wherein the width of the TPO membrane is the same or substantially the same as the profile spacing(s).

6. The TPO membrane roof system according to claim 1, the TPO membrane consists of a single layer.

7. The TPO membrane roof system according to claim 1, the TPO membrane includes at least 2 layers.

8. The TPO membrane roof system according to claim 1 wherein the TPO membrane—first profile seam is adhered to the first profile base and the TPO membrane—second profile seam is adhered to the second profile base further consists of a water resistant seal along the TPO membrane—first profile seam and the TPO membrane—second profile seam.

9. The TPO membrane roof system according to claim 1, wherein the width of TPO membrane is about 1 foot to about 3 feet.

10. The TPO membrane roof system according to claim 1, wherein the width of TPO membrane is about 2 feet.

11. The TPO membrane roof system according to claim 1, wherein the substrate consists of a low or zero slope roof.

12. A method for cladding a structure having a roofing substrate, the method consisting of:

positioning two or more profiles, each profile having a base and a body fixed above the base, on the substrate, wherein the two or more profiles are parallel or substantially parallel to each other and separated from each other by spacing(s);

fastening the base of each of the two or more profiles to the substrate;

applying a TPO membrane between each pair of profiles, the TPO membrane having sufficient width to at least partly overlap the base of each adjacent profile and form two or more TPO membrane—profile seams, wherein each TPO membrane—profile seam adheres the TPO membrane to the profile base; and sealing each TPO membrane—profile seam to the profile base.

13. The method for cladding a structure according to claim 12, wherein the width of the TPO membrane is the same or substantially the same as the profile spacing(s).

14. The method for cladding a structure according to claim 12, wherein the width of TPO membrane is about 1 foot to about 3 feet.

15. The method for cladding a structure according to claim 12, wherein fastening the base of each of the two or more profiles to the substrate further consists of adhering each of the two or more profiles to the substrate.

16. The method for cladding a structure according to claim 12, wherein fastening the base of each of the two or more profiles to the substrate further consists of mechanically fastening each of the two or more profiles to the substrate.

17. The method for cladding a structure according to claim 12, wherein sealing each TPO membrane—profile seam further consists of welding, caulking, gluing, or combinations thereof.

18. The method for cladding a structure according to claim 12, wherein the TPO membrane is a colored TPO membrane.

19. The method for cladding a structure according to claim 12, wherein the TPO membrane is configured to mimic a metallic roof material.

20. The method for cladding a structure according to claim 12 wherein sealing each TPO membrane—profile seam to the profile base further consists of rolling the overlap to secure it to the underlying profile base.

* * * * *